US009033114B2

(12) United States Patent
Mizon

(10) Patent No.: US 9,033,114 B2
(45) Date of Patent: May 19, 2015

(54) DETERMINING ELEVATOR CAR POSITION

(75) Inventor: John Mizon, Cham (CH)

(73) Assignee: Inventio AG, Hergiswil NW (CH)

( * ) Notice: Subject to any disclaimer, the term of this patent is extended or adjusted under 35 U.S.C. 154(b) by 691 days.

(21) Appl. No.: 13/336,626

(22) Filed: Dec. 23, 2011

(65) Prior Publication Data

US 2012/0193169 A1 Aug. 2, 2012

(30) Foreign Application Priority Data

Dec. 23, 2010 (EP) ..... 10196870

(51) Int. Cl.
*B66B 1/34* (2006.01)
*B66B 19/00* (2006.01)
*B66B 1/00* (2006.01)

(52) U.S. Cl.
CPC ..... *B66B 19/007* (2013.01); *B66B 1/00* (2013.01); *B66B 1/3492* (2013.01)

(58) Field of Classification Search
USPC ..... 187/247, 248, 277, 284, 291–293, 301, 187/316, 391–394
See application file for complete search history.

(56) References Cited

U.S. PATENT DOCUMENTS

| | | | | |
|---|---|---|---|---|
| 4,880,082 | A | 11/1989 | Kahkipuro et al. | |
| 5,357,064 | A * | 10/1994 | Boyce et al. | 187/247 |
| 5,389,748 | A * | 2/1995 | Burke et al. | 187/247 |
| 6,892,861 | B2 * | 5/2005 | Friedli | 187/247 |
| 6,935,465 | B2 * | 8/2005 | Friedli | 187/247 |
| 6,982,861 | B2 * | 1/2006 | Lee et al. | 361/223 |
| 7,073,633 | B2 * | 7/2006 | Weinberger et al. | 187/393 |
| 7,484,598 | B2 * | 2/2009 | Tyni et al. | 187/393 |
| 7,958,970 | B2 * | 6/2011 | Ma et al. | 187/394 |
| 8,517,149 | B2 * | 8/2013 | Flynn et al. | 187/247 |
| 8,540,057 | B2 * | 9/2013 | Schuster et al. | 187/391 |
| 8,640,831 | B2 * | 2/2014 | Talonen | 187/391 |
| 8,678,143 | B2 * | 3/2014 | Bunter | 187/393 |
| 2012/0267203 | A1 * | 10/2012 | Friedli et al. | 187/388 |

FOREIGN PATENT DOCUMENTS

| | | | |
|---|---|---|---|
| WO | WO 2007/020322 | A1 | 2/2007 |
| WO | WO 2008/051217 | A1 | 5/2008 |
| WO | WO 2009/068725 | A1 | 6/2009 |

OTHER PUBLICATIONS

European Search Report dated Jul. 19, 2011 issued in corresponding European patent application No. 10196870.

* cited by examiner

*Primary Examiner* — Anthony Salata
(74) *Attorney, Agent, or Firm* — Stroock & Stroock & Lavan LLP

(57) ABSTRACT

Elevator car position information can be determined based at least in part on readings from a sensor attached to the elevator car. The sensor readings provide movement information for the car. Some elevator installations are also configured with additional sensors for calibrating the sensor attached to the elevator car. The sensors can be used with, for example, an elevator installation that is being modernized.

18 Claims, 7 Drawing Sheets

DETERMINING ELEVATOR CAR POSITION

CROSS-REFERENCE TO RELATED APPLICATION

This application claims priority to European Patent Application No. 10196870.9, filed Dec. 23, 2010, which is incorporated herein by reference.

FIELD

This disclosure relates generally to determining the position of an elevator car, for example, the location of the car relative to one or more floors in a building.

BACKGROUND

An elevator installation is often configured to display location information for one or more elevator cars (e.g., which floor or floors the elevator cars are currently at or near). Such information is traditionally provided by an elevator control unit in the installation, the control unit being generally responsible for handling operations like moving the elevator cars in response to elevator calls. If, for example, a multiple-elevator system is being modernized, a modernization elevator control unit may need car position information for a non-modernized elevator car. However, sometimes the location information is not available or is not easily available from an elevator control unit. During a modernization, it may be difficult for a modernized elevator control unit to obtain location information from a non-modernized elevator control unit.

SUMMARY

Elevator car position information can be determined based at least in part on readings from a sensor attached to the elevator car. The sensor readings provide movement information for the car. Some elevator installations are also configured with additional sensors that indicate the elevator car information for calibrating the sensor attached to the elevator car. During a modernization of a multiple-elevator installation, position information for a non-modernized elevator car can be determined based at least in part on sensor readings from the car.

In some embodiments, an elevator method comprises determining a vertical position of an elevator car in an elevator shaft based at least in part on elevator movement data recorded by an accelerometer in the passenger area of the elevator car. An indication of the vertical position of the elevator car can be displayed. The accelerometer can be installed in the passenger area during a modernization of an elevator system, the elevator system comprising the elevator car and the elevator shaft. The accelerometer can be removed from the elevator car after the elevator car has been modernized. In some cases, the method further comprises installing the accelerometer inside the elevator car prior to modernization of an elevator system. In further embodiments, one or more operations of the elevator car are controlled by a legacy control unit and the determining the vertical position of the elevator car is performed by a modernization control unit.

In some embodiments, an elevator installation comprises: at least one modernized elevator car; at least one non-modernized elevator car comprising a passenger space and an exterior, the at least one non-modernized elevator car being disposed in at least one elevator shaft; at least one processor; and at least one accelerometer mounted in the passenger space of the at least one non-modernized elevator car and coupled to the processor, the processor being configured to determine a vertical location of the at least one non-modernized elevator car in the at least one elevator shaft based on information received from the at least one accelerometer. The elevator installation can further comprise a legacy control system, the processor being configured to determine the vertical location of the at least one non-modernized elevator car without elevator car position information from the legacy control system. The determined vertical location can indicate one or more floors in a building of the elevator installation. The at least one processor can be part of an elevator control system for the installation. In some cases the at least one accelerometer was installed in the non-modernized elevator car during the modernization. The installation can further comprise a display coupled to the at least one processor, the display being configured to display the determined vertical location of the at least one non-modernized elevator car. A calibration sensor can be placed in the at least one elevator shaft. The calibration sensor can be configured to indicate a specific floor at which the non-modernized elevator car is located.

DETAILED DESCRIPTION

Any of the methods, apparatus and systems described herein can be used with a wide variety of elevator installations and/or with a wide variety of modernization procedures.

Various embodiments disclosed herein describe an elevator car (sometimes referred to as an "elevator cabin" or an "elevator cage") disposed in an elevator shaft. Unless explicitly stated otherwise, embodiments of technologies disclosed herein can be used with elevator systems comprising multiple elevator shafts, each shaft having one or more elevator cars disposed therein.

Figure 1:
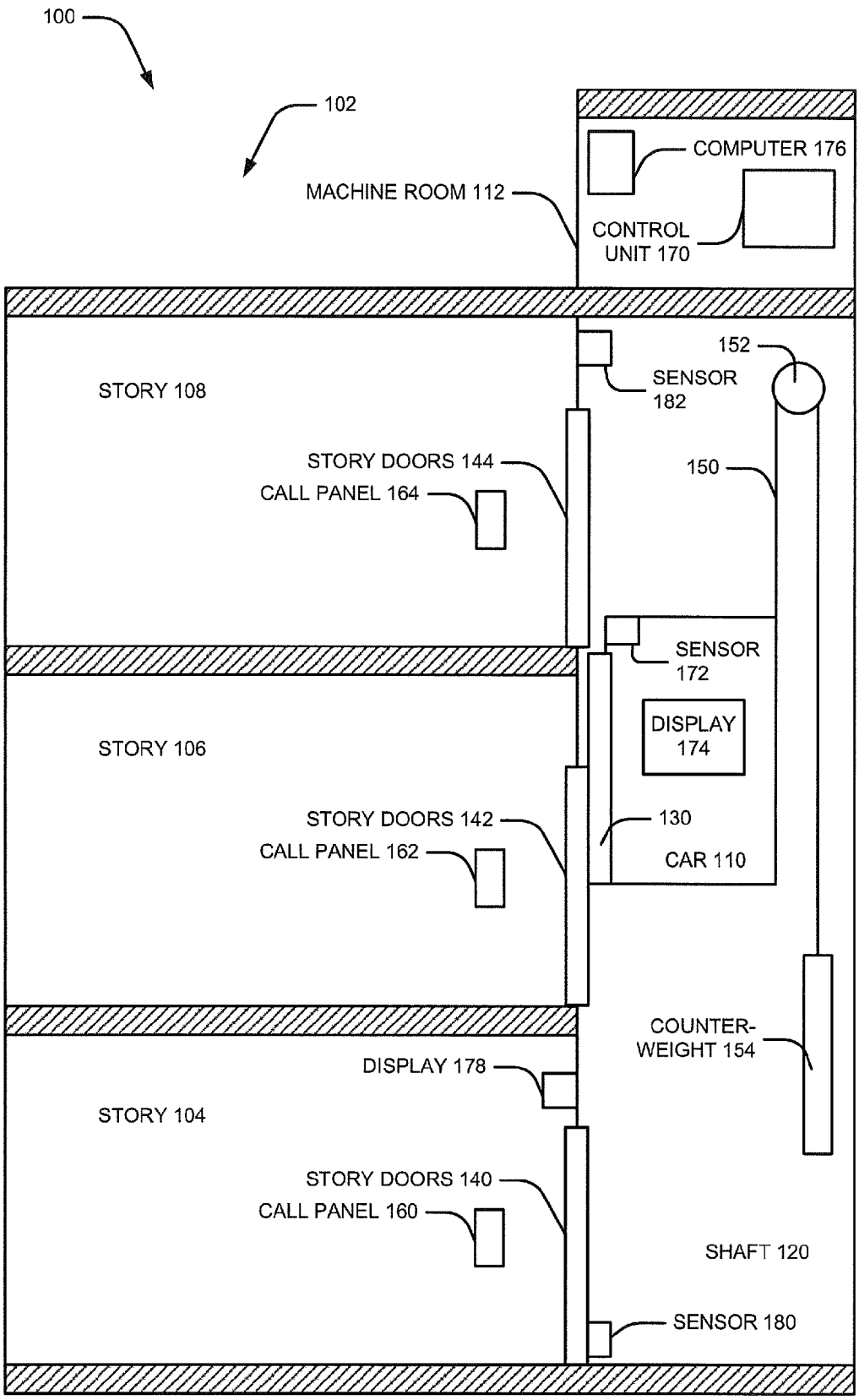
FIG. 1 shows an exemplary embodiment of an elevator installation at a building.

FIG. 1 shows an exemplary embodiment of an elevator installation 100 at a building 102. An elevator car 110 is disposed in a generally vertical elevator shaft 120. The elevator installation 100 services two or more stories 104, 106, 108 in the building 102. The car 110 moves generally vertically in the shaft 120 to various locations within the shaft 120. For example, the car 110 stops at the stories 104, 106, 108. Passengers and/or cargo can move between the car 110 and the stories 104, 106, 108 through a car door 130 and story doors 140, 142, 144. Movement of the car 110 within the shaft 120 can be effected using various arrangements. An example arrangement, depicted in FIG. 1, comprises a support 150 that at least partially bears the weight of the car 110 and its contents during operation. An elevator drive 152 raises and lowers the car 110 using the support 150. In at least some embodiments, the car 110 is connected to one or more counterweights 154 using the support 150. Other arrangements can also be used to move the car 110.

Some embodiments of the installation 100 comprise one or more call panels 160, 162, 164, which are located on one or more of the stories 104, 106, 108. In some cases, the call panels 160, 162, 164 allow for calling an elevator, possibly including a desired elevator direction (e.g., up or down). The installation 100 can further comprise one or more panels inside the car 110 to allow for selection of one or more destination floors for the car 110. One or more of the disclosed technologies can be used with elevator call control systems that allow for destination selection from outside of the car 110 (e.g., a so-called destination control system, such as the Miconic 10 system available from the Schindler Group).

Operation of the installation 100 is controlled by at least one elevator control unit 170. In some embodiments, the control unit 170 comprises, for example, at least one processor, memory, and one or more computer-readable storage media having encoded thereon instructions which cause the processor to perform one or more method acts. The control unit 170 is coupled to one or more other components of the installation 100 (using wired and/or wireless connections, not shown), for example, the call panels 160, 162, 164, the car door 130, the story doors 140, 142, 144, and/or the elevator drive 152.

Some versions of the installation 100 include a machine room 112 containing one or more components (e.g., the control unit 170).

In some embodiments, the installation 100 further comprises at least one sensor 172 configured to aid in detecting movement of the car 110. The sensor 172 comprises an accelerometer. The sensor 172 is coupled to a position computer 176. In some embodiments, the position computer 176 comprises, for example, at least one processor, memory, and one or more computer-readable storage media having encoded thereon instructions which cause the processor to perform one or more method acts. The position computer 176 can be integrated with the control unit 170, or the two can be separate components.

Sometimes, the sensor 172 is positioned (e.g., placed or mounted) in the interior of the car 110. As used in this application, the "interior" or the "passenger space" of the car refers to the passenger area of the car 110 that is immediately accessible to a passenger entering the car 110 through the car door 130. The interior of the car does not include, for example, areas that are accessed through a roof door in the cabin. The sensor 172 can be positioned on, for example, a wall panel, a door, ceiling panel, or a floor of the interior of the car 110.

In other cases, the sensor 172 is positioned (e.g., placed or mounted) on the exterior of the car 110.

The sensor 172 can be configured to record information regarding only generally vertical movement of the car 110. In further embodiments, the sensor 172 can be configured to record, for example, information regarding movement in one or more other directions.

Figure 2:
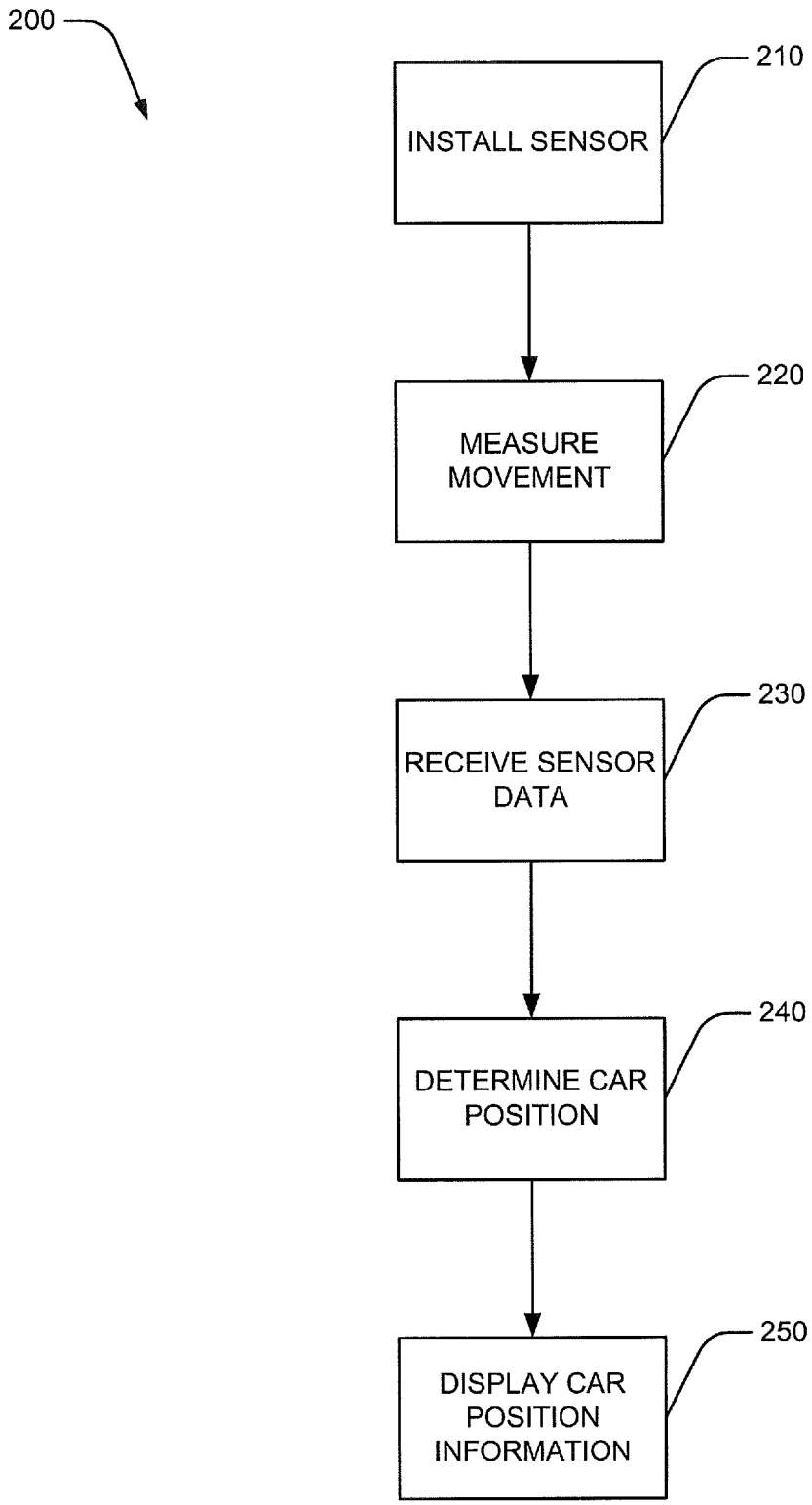
FIG. 2 shows a block diagram of an exemplary embodiment of a method for determining elevator car position in an elevator shaft.

FIG. 2 shows a block diagram of an exemplary embodiment of a method 200 for determining an elevator car's position in an elevator shaft. In a method act 210, at least one sensor is installed (e.g., placed or mounted) in or on an elevator car. As the elevator car moves within the elevator shaft, elevator car movement is measured by the sensor in a method act 220, producing sensor data. In some embodiments, the sensor data is received by another component in a method act 230. For example, the sensor data can be received by the position computer 176 or by another component. (In some cases, where the position computer 176 and the control unit 170 are separate, the control unit 170 receives no elevator movement information or no information at all from the sensor.) Based at least in part on the received sensor data, the elevator car position is determined in a method act 240. The car position can be calculated using any suitable method. For example, changes in acceleration of the car over time can be used to determine how far the car has moved relative to a reference location (e.g., a known starting floor). In at least some cases, the method 200 allows for determining the car position by "dead reckoning." In particular cases, elevator car position is determined based on sensor data measured from only inside the car. In further cases, at least some calculations for determining the elevator car position are performed by the sensor.

In further embodiments, the determined car position (e.g., which floor the elevator car is at and/or in which direction the car is moving) is displayed on one or more displays in a method act 250. The one or more displays can be positioned inside the car, at one or more floors in the building, and/or elsewhere. FIG. 1 shows a display 174 inside the car 110 and a display 178 above the story door 140 on the story 104.

Additional embodiments of the disclosed technologies provide supplemental information for determining the elevator car position. For example, a reference location can be provided to the position computer 176. The reference location can comprise, for example, a floor in the installation and/or another location.

As another example of providing supplemental information, FIG. 1 shows two calibration sensors 180, 182 positioned in the shaft 120. In at least some cases, the sensors 180, 182 are easily mounted to the car 110 and/or the shaft 120 and have no association with pre-existing wiring in the elevator installation. The sensors 180, 182 comprise, for example, a car-mounted lever switch and/or a roller-level assembly-activated switch driven by a hoistway-mounted cam. Although the calibration sensors 180, 182 are depicted in FIG. 1 as being located near the lower and upper ends of the shaft 120, respectively, other positions can be used, too.

When the car 110 is within a predetermined distance (e.g., near and/or contacting) of at least one of the calibration sensors 180, 182, a signal is sent from the corresponding sensor or sensors to the position computer 176. The position computer 176 can use this information to, for example, supplement and/or replace the information received from the sensor 172. In at least some cases, the calibration sensors 180, 182 serve as "reset" sensors to provide one or more reference points from which to calculate the car position using readings from the sensor 172.

Figure 3:
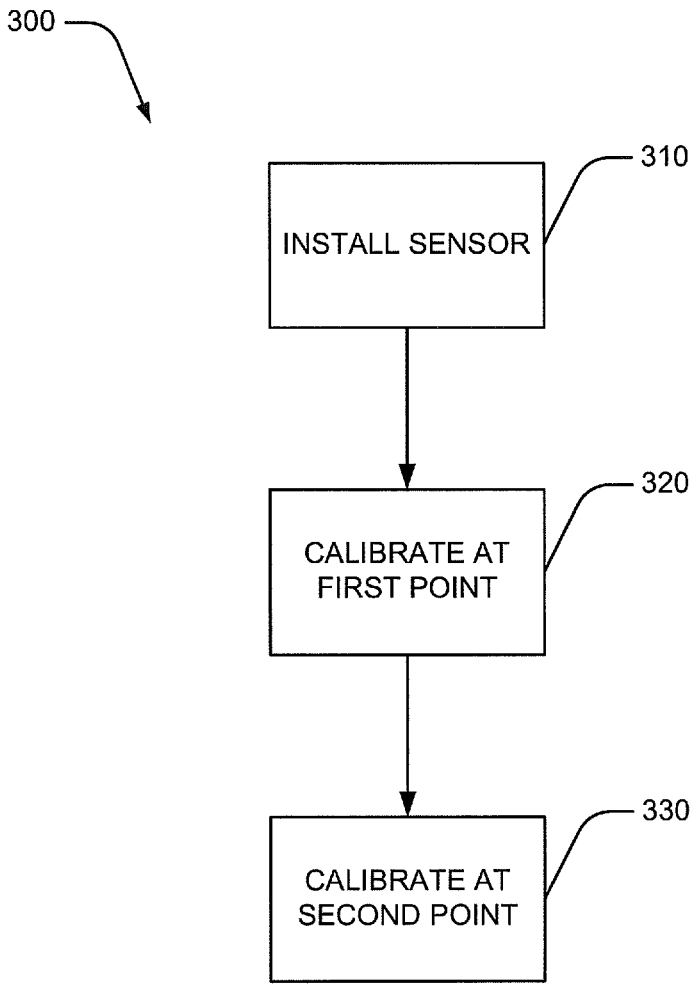
FIG. 3 shows a block diagram of an exemplary embodiment of a method for calibrating an elevator installation.

FIG. 3 shows a block diagram of an exemplary embodiment of a method 300 for calibrating an elevator installation (e.g., the installation 100) having a sensor such as the sensor 172. The sensor is installed in or on the elevator car in a method act 310. In a method act 320, the car is moved to a first reference point. In some embodiments, the first reference point is a position where the car activates a first calibration sensor. For example, the car can be moved to the bottom position in the elevator shaft to activate a sensor in that area. In further embodiments, the first reference point is a selected floor in the installation (e.g., the ground floor). In future calculations, the installation can use this position as a reference point.

In further versions of the method 300, the car is moved to a second reference point in a method act 330. In some embodiments, the second reference point is a position where the car activates a second calibration sensor. For example, the car can be moved to the top position in the elevator shaft to activate a sensor in that area. In further embodiments, the second reference point is a selected floor in the installation (e.g., the top floor). This input serves as a second reference point.

The method 300 can be performed as part of an automated procedure or a manual procedure.

Figure 4:
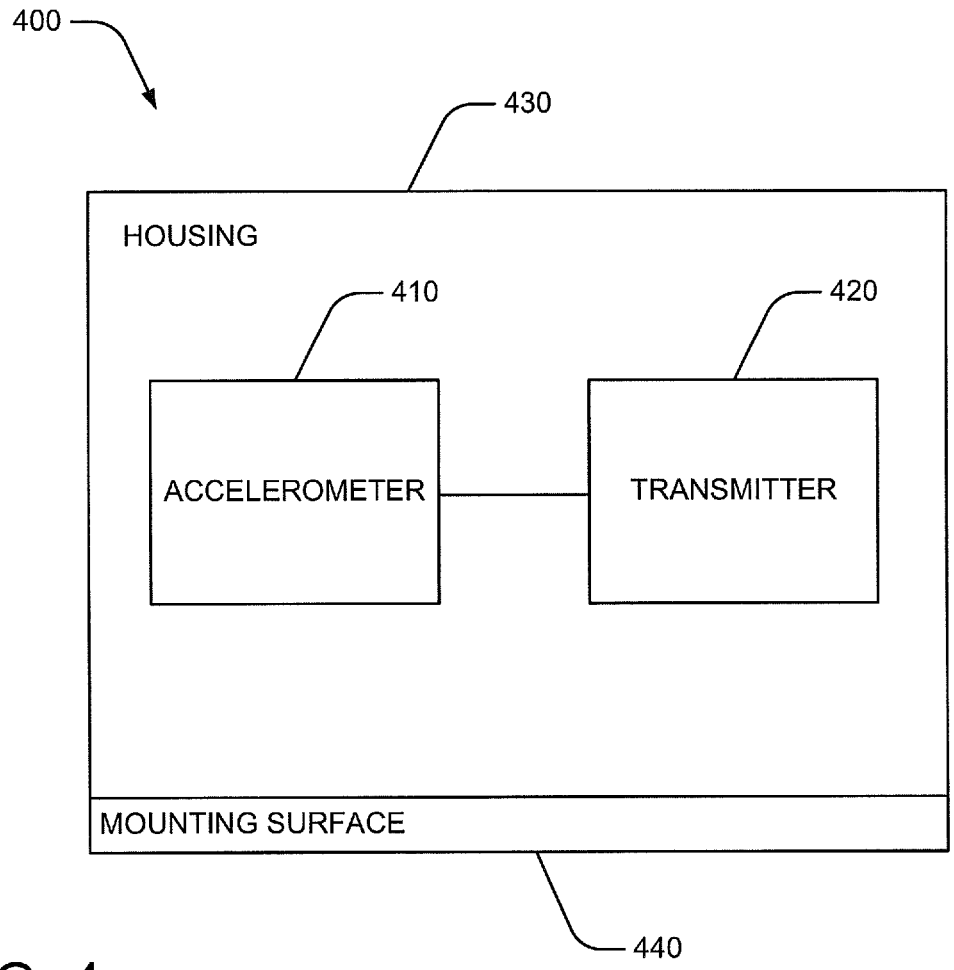
FIG. 4 shows a block diagram of an exemplary embodiment of a sensor.

FIG. 4 shows a block diagram of an exemplary embodiment of a sensor 400 (e.g., the sensor 172 discussed above) configured to provide information about movement of an elevator car. The sensor 400 comprises at least one accelerometer 410, which can be a single- or multiple-axis accelerometer. Non-limiting examples of possible accelerometers include: capacitive; piezoelectric; piezoresistive; Hall effect; magnetoresistive; and heat transfer. Some embodiments of the sensor 400 comprise a housing 430 that attaches to or at least partially encloses the accelerometer 410. The sensor 400 further comprises a mounting surface 440 that can be used to attach the sensor 400 to the elevator car 110. The sensor 400 can also comprise a transmitter 420, coupled to the accelerometer 410, that is configured to transmit readings obtained by the accelerometer 410 to one or more other components in the installation 100. In some cases, the sensor 400 is incorporated into another component, such as a camera.

Embodiments of the disclosed technologies can also be used with elevator modernization activities. As used in this application and in the claims, terms like "modernize" and "modernization" refer to activities in which one or more components of an elevator installation are replaced and/or upgraded to improve some aspect of the installation. Modernization can involve replacing hardware and/or software components. Terms like "non-modernized" refer to components, systems or parts of systems which have not undergone modernization.

It is normally difficult or impossible to complete a modernization of a multiple-elevator installation before at least some of the installation needs to be placed in service. In other words, it may not be possible or convenient to halt the use of every elevator in an installation until the modernization is completed. Typically, one or more elevators are taken out of service while one or more other elevators in the installation remain available for use. Thus, during modernization, the installation can simultaneously have elevators in three different conditions: non-modernized but operational; currently being modernized and not operational; and modernized and operational.

Figure 5:
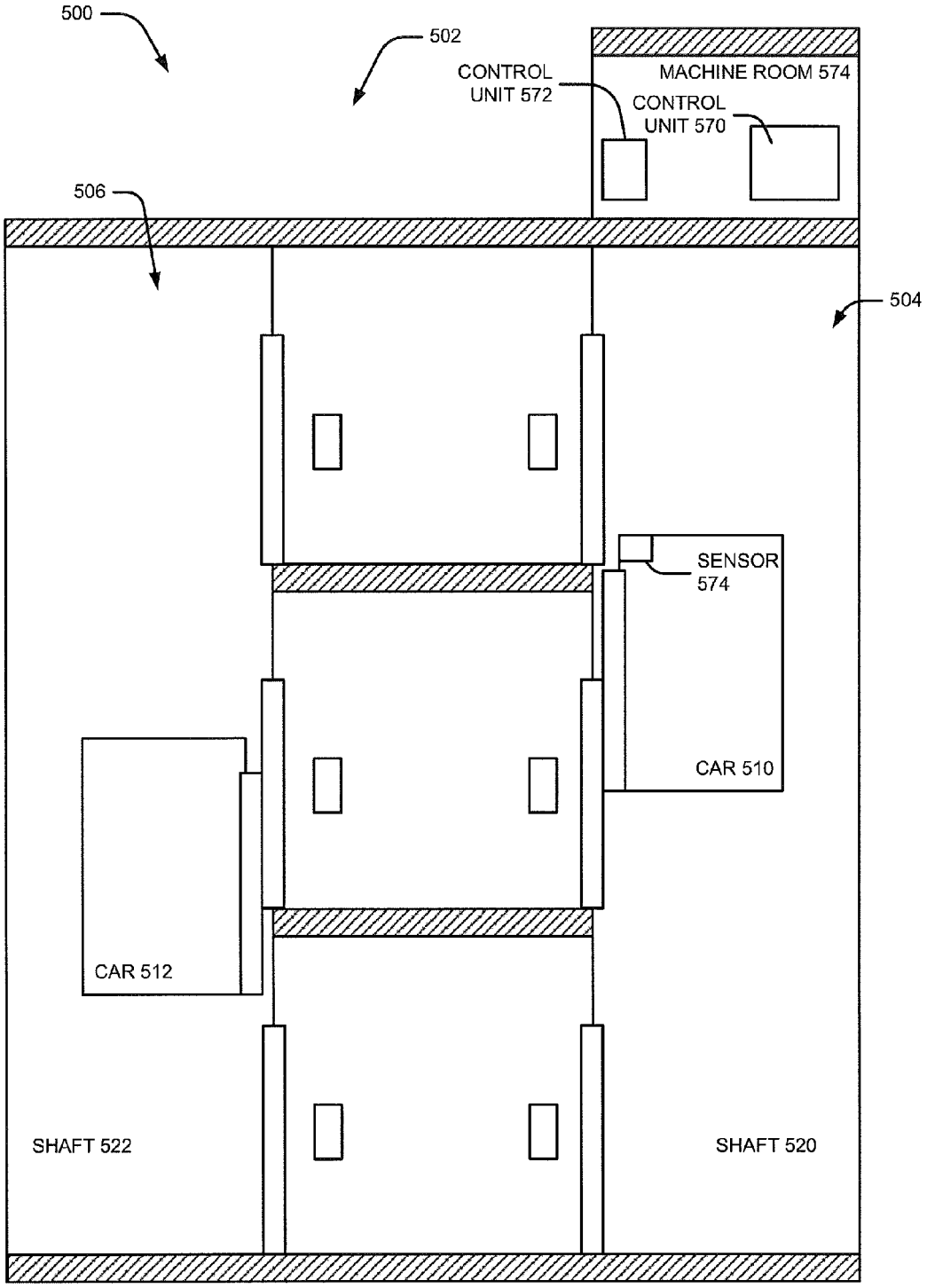
FIG. 5 shows an exemplary embodiment of a multiple-elevator installation.

FIG. 5 shows a diagram of an exemplary embodiment of a multiple-elevator installation 500 that is undergoing modernization at a building 502. The elevator 504 on the right-hand side of the figure, comprising an elevator car 510 disposed in an elevator shaft 520, is non-modernized but operational. The elevator 506 on the left-hand side of the figure, comprising an elevator car 512 disposed in an elevator shaft 522, is modernized and operational. (For clarity, FIG. 5 does not depict any other elevators in the installation 500, including any elevator that is currently being modernized and is not operational.)

The installation 500 comprises a "legacy" control unit 570, which performs at least some of the control functions (e.g., movement of the car 510, operation of relevant doors) for the non-modernized, operational elevator 504. Generally, the legacy control unit 570 has been in the installation 500 since before the start of the modernization activities. (The legacy control unit is sometimes also called a "non-modernized" control unit.) The installation 500 further comprises a modernization control unit 572, which performs at least some of the control functions for the modernized, operational elevator 506. Generally, the modernization control unit 572 is added to the installation 500 as part of the modernization activities. The modernized control unit 572 can comprise a destination control system. The control units 570, 572 can be located in a machine room 574, or elsewhere.

Generally, elevator car position information for the cars 510, 512 is useful and/or necessary. In at least some cases, elevator car position information for the non-modernized elevator 504 is available from the legacy control unit 570. However, during modernization, it can be difficult and/or undesirable to obtain elevator car position information from the legacy control unit 570. For example, information about the workings of the legacy control unit 570 and/or how to interface with the unit 570 may be unavailable. Creating an interface with the legacy control unit 570 could affect the operation of the non-modernized elevator 504, perhaps in unintended ways.

Figure 6:
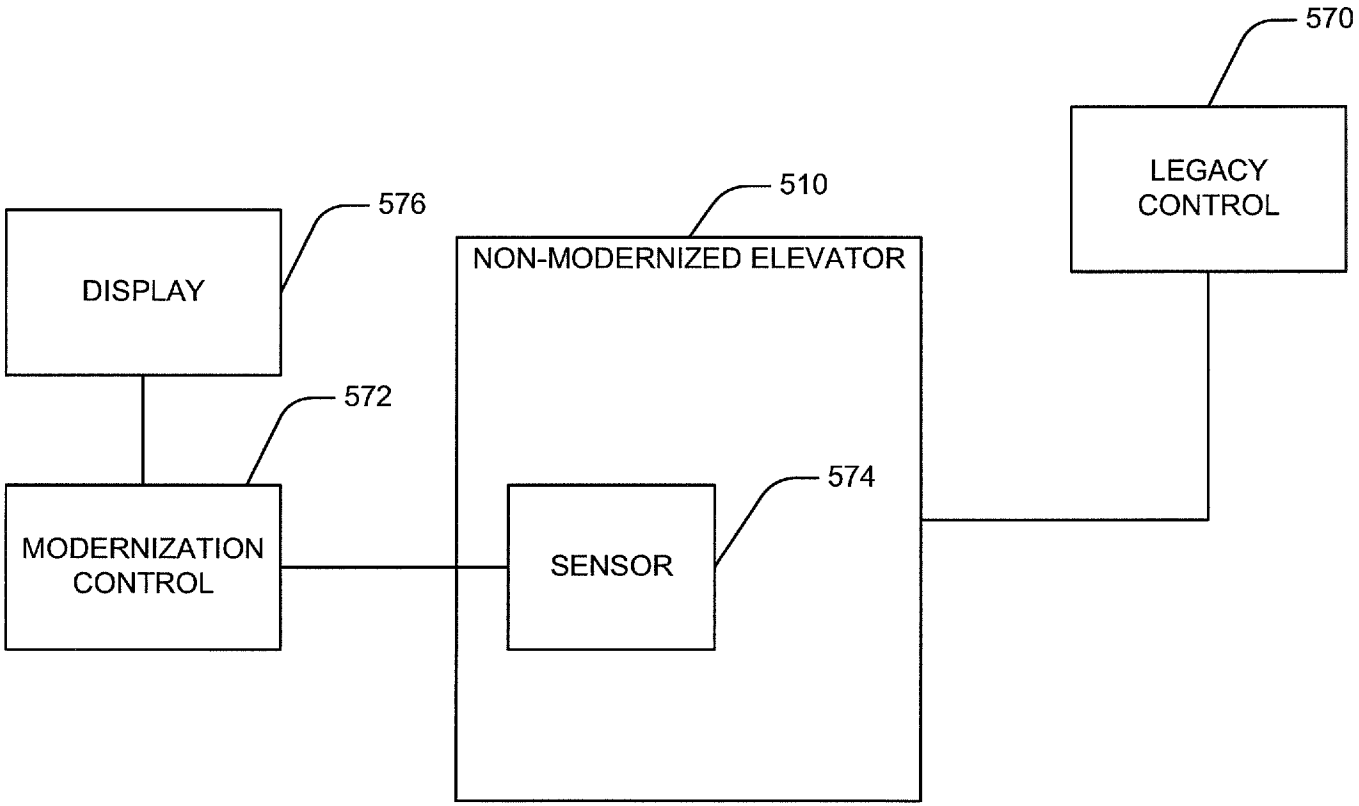
FIG. 6 shows a block diagram of an exemplary embodiment of a system for determining elevator car position.

Alternatively, elevator car position information for the non-modernized elevator 504 can be determined using a sensor 574, which is similar to the sensors 172, 400 described above. The sensor 574 can be used with a method similar to the method 200 and/or the method 300 described above. FIG. 6 shows a block diagram of an exemplary embodiment of a system using this approach, the system comprising components of the installation 500. The sensor 574 in the interior of or on the non-modernized elevator car 510 provides elevator movement information to the modernization control unit 572 and/or to a position computer (not shown). Accordingly, position information for the elevator car 510 can be determined without position information from the legacy control unit 570. Determined elevator position information can be shown on a display 576. Meanwhile, the legacy control unit 570 performs one or more functions for the non-modernized elevator.

In another non-limiting example, an elevator company representative visits a potential customer's elevator installation. The representative discusses with the customer possible modernization of the installation. Possibly, the representative attaches a sensor (similar to the sensors 172, 400) to an interior wall panel of an elevator car in the installation. The sensor serves as a visible reminder to the potential customer of the possible modernization.

When a modernization of the installation begins, a first elevator in the installation is removed from service, modernized, and then placed back into service. A second elevator in the installation is then removed from service for modernization. At this point, the first elevator (the modernized elevator) is controlled by a modernization control unit. The modernization control unit operates a destination control system and also operates displays for the installation indicating the locations of elevator cars that are in operation.

A third, non-modernized elevator is still in operation and controlled by a legacy control unit. The modernization control unit needs elevator car position information for the third elevator, but obtaining this information directly from the legacy control unit may be difficult and/or may require modifications of the legacy control unit that would interfere with that unit's operation. Instead, elevator car movement data is recorded using the sensor in the elevator car. Using one or more technologies described herein, elevator car position data for the third elevator is determined using the elevator car movement data, without obtaining this data from the legacy control unit.

Once modernization of the third elevator is completed (e.g., once it is operated by the modernization control unit instead of the legacy control unit), the sensor can be removed from the third elevator's car.

In a further non-limiting example, an apparatus comprises: a sensor configured to record vertical elevator car motion data from the interior of an elevator car; a transmitter, the transmitter being configured to transmit the vertical elevator car motion data to a processor, the processor configured to determine an elevator car position based at least in part on the transmitted vertical elevator car motion data; and at least one mounting surface configured to be affixed to the interior of the elevator car.

In yet another non-limiting example, one or more computer-readable storage media comprise a first storage media portion having encoded thereon a first set of instructions, the first set of instructions being configured to cause a processor to determine a vertical position of an elevator cabin based at least in part on cabin displacement information recorded by a sensor inside the elevator cabin. A second storage media portion has encoded thereon a second set of instructions, the second set of instructions being configured to cause a processor to determine the vertical position of the elevator cabin based at least in part on a signal from one or more reset switches triggered by the elevator cabin. A third storage media portion has encoded thereon a third set of instructions, the third set of instructions being configured to cause the processor to provide the determined vertical position of the elevator car to a destination control system.

In another non-limiting example, an elevator installation comprises: at least one elevator car, the elevator car comprising an interior and an exterior; at least one elevator shaft, the at least one elevator car being disposed in the at least one elevator shaft; means for sensing motion of the elevator car from inside the elevator car; and means for determining the position of the elevator car in the elevator shaft based at least in part on data generated by the means for sensing motion.

Figure 7:
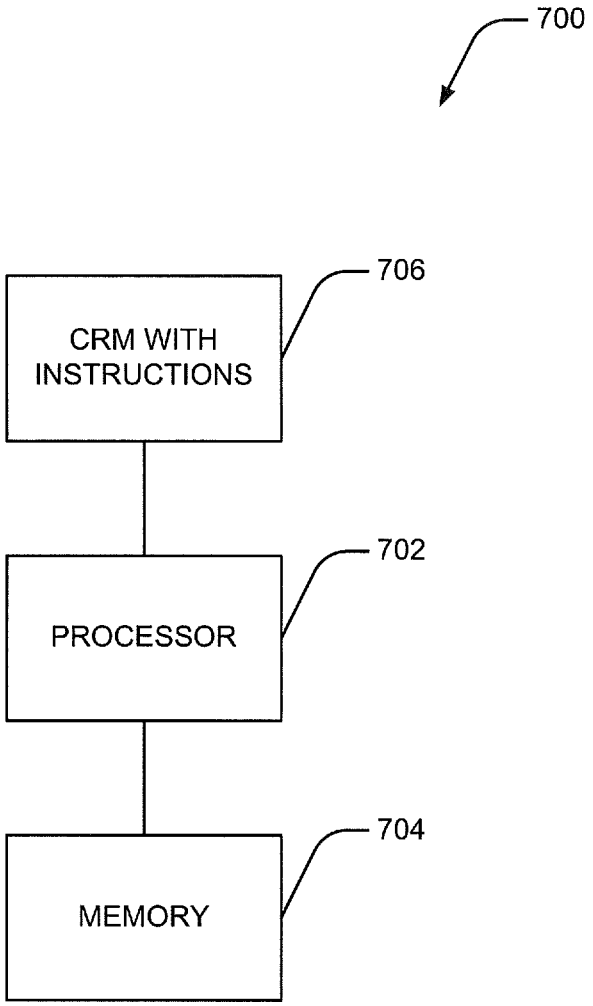
FIG. 7 shows a block diagram of an exemplary embodiment of a computing environment.

One or more of the disclosed method acts can be performed using a computing environment. The computing environment can be incorporated into, for example, a position computer and/or an elevator control unit. The computing environment can also be separate from other components. FIG. 7 shows a block diagram of an exemplary embodiment of a computing environment 700, which comprises at least one processor 702 coupled to at least one memory 704. The processor 702 is configured to receive, from one or more computer-readable storage media 706, instructions for one or more method acts disclosed herein. The computer-readable storage media (CRM) 706 comprise, for example, one or more optical disks, volatile memory components (such as DRAM or SRAM), and/or nonvolatile memory components (such as hard drives or ROM). The computer-readable storage media 706 are not comprised purely of transitory signals.

Having illustrated and described the principles of the disclosed technologies, it will be apparent to those skilled in the art that the disclosed embodiments can be modified in arrangement and detail without departing from such principles. In view of the many possible embodiments to which the principles of the disclosed technologies can be applied, it should be recognized that the illustrated embodiments are only examples of the technologies and should not be taken as limiting the scope of the invention. Rather, the scope of the invention is defined by the following claims and their equivalents. I therefore claim as my invention all that comes within the scope and spirit of these claims.

I claim:

1. An elevator method comprising determining a position of an elevator car in an elevator shaft based at least in part on elevator movement data generated by an accelerometer in a passenger area of the elevator car, the determining being performed without elevator car position information from a legacy control system.

2. The elevator method of claim 1, further comprising displaying an indication of the position of the elevator car.

3. The elevator method of claim 1, further comprising installing calibration sensors in the elevator shaft.

4. The elevator method of claim 3, further comprising indicating by the calibration sensors, a specific floor at which the elevator car is located.

5. The elevator method of claim 1, further comprising installing the accelerometer inside the elevator car prior to modernization of an elevator system, the elevator system comprising the elevator car and the elevator shaft.

6. The elevator method of claim 1, further comprising controlling by the legacy control system one or more operations of the elevator car, wherein a modernization control unit utilizes movement data by the accelerometer to determine a vertical position of the elevator car.

7. An elevator installation undergoing a modernization, the elevator installation comprising:

at least one modernized elevator car;

at least one non-modernized elevator car comprising a passenger space and an exterior, the at least one non-modernized elevator car being disposed in at least one elevator shaft;

at least one processor;

at least one accelerometer mounted in the passenger space of the at least one non-modernized elevator car and coupled to the processor, the processor being programmed to determine a vertical location of the at least one non-modernized elevator car in the at least one elevator shaft based on information received from the at least one accelerometer; and a legacy control system, the processor being programmed to determine the vertical location of the at least one non-modernized elevator car without elevator car position information from the legacy control system.

8. The elevator installation of claim 7, the determined vertical location indicating one or more floors in a building of the elevator installation.

9. The elevator installation of claim 7, the at least one processor being part of an elevator control system for the installation.

10. The elevator installation of claim 7, the at least one processor being separate from an elevator control system for the installation.

11. The elevator installation of claim 7, wherein the at least one accelerometer was installed in the non-modernized elevator car during the modernization.

12. The elevator installation of claim 7, further comprising a display coupled to the at least one processor, the display being configured to display the determined vertical location of the at least one non-modernized elevator car.

13. The elevator installation of claim 7, further comprising a calibration sensor in the at least one elevator shaft.

14. The elevator installation of claim 13, the calibration sensor being configured to indicate a specific floor at which the non-modernized elevator car is located.

15. One or more computer-readable storage media having encoded thereon instructions that, when executed by a processor, cause the processor to perform a method, the method comprising:

receiving readings from an accelerometer in a passenger area of a non-modernized elevator car;

based on the received readings, determining a position of the non-modernized elevator car in a building, and operating a modernized elevator car and the non-modernized elevator car based on the determined position of the non-modernized elevator car.

16. The one or more computer-readable storage media of claim 15, the method further comprising transmitting the received readings from the accelerometer to the processor.

17. The one or more computer-readable storage media of claim 15, the method further comprising a step for calibrating the accelerometer.

18. An elevator control system control unit, comprising:

a processor; and one or more computer-readable storage media having encoded thereon instructions that, when executed by the processor, cause the processor to perform a method, the method comprising, receiving elevator movement data generated by an accelerometer in a passenger area of a non-modernized elevator car, based on the received elevator movement data, determining a position of the non-modernized elevator car in a building, and operating a modernized elevator car and the non-modernized elevator car based on the determined position of the non-modernized elevator car.

* * * * *